US006807384B2

(12) United States Patent
Okubo et al.

(10) Patent No.: US 6,807,384 B2
(45) Date of Patent: Oct. 19, 2004

(54) IMAGE FORMING APPARATUS

(75) Inventors: Kazuhiro Okubo, Shizuoka (JP); Masahide Kinoshita, Shizuoka (JP); Masaki Ojima, Shizuoka (JP); Motoki Adachi, Shizuoka (JP); Masao Uyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/418,054

(22) Filed: Apr. 18, 2003

(65) Prior Publication Data

US 2004/0005158 A1 Jan. 8, 2004

(30) Foreign Application Priority Data

Apr. 19, 2002 (JP) ..... 2002-118236

(51) Int. Cl.[7] ..... G03G 15/02
(52) U.S. Cl. ..... 399/50; 399/149; 399/150
(58) Field of Search ..... 399/50, 53, 71, 399/148, 149, 150

(56) References Cited

U.S. PATENT DOCUMENTS 4,851,960 A 7/1989 Nakamura et al. ..... 361/225
6,421,512 B2 7/2002 Watanabe et al. ..... 399/149
6,611,668 B2 * 8/2003 Watanabe et al. ..... 399/129
2003/0049048 A1 3/2003 Yoshikawa et al. ..... 399/129

FOREIGN PATENT DOCUMENTS

JP 63-149669 6/1988
JP 5-273849 * 10/1993
JP 2001-215798 8/2001

* cited by examiner

*Primary Examiner*—Hoan Tran
(74) *Attorney, Agent, or Firm*—Fitzpatrick, Cella, Harper & Scinto

(57) ABSTRACT

To provide an image forming apparatus improving discharging of a developer from charge providing member for providing charge to the developer remaining on an image bearing member to the image bearing member, the developer is charged from the charge providing member to the image bearing member. When a developer discharging region of the image bearing member is disposed at a charging position, charging member is applied with a voltage having a direct current component of an absolute value equal to or smaller than an absolute value of voltage applied to the charge providing member without an alternating current component.

70 Claims, 3 Drawing Sheets

IMAGE FORMING APPARATUS

BACKGROUND OF THE INVENTION

1. Field of the Invention

The present invention relates to an image forming apparatus of, for example, a copier, a printer or a facsimile apparatus or the like.

2. Description of the Related Art

In a related art, a transferring system image forming apparatus of a copier, a printer, a facsimile or the like using a transferring type electrophotography system is constituted by a photosensitive member which is an image bearing member generally of a rotary drum type, a charging apparatus for charging the photosensitive member uniformly at predetermined polarity and potential (charging step), an exposing apparatus as information writing means for forming an electrostatic latent image to the charged photosensitive member (exposing step), a developing apparatus for visualizing the electrostatic latent image formed on the photosensitive member by a toner which is a developer (exposing step), a transferring apparatus for transferring the toner image from a face of the photosensitive member to a transferring material of paper or the like (transferring step), a cleaning apparatus for cleaning the face of the photosensitive member by removing the toner remaining on the photosensitive member after the transferring step although an amount thereof is small (cleaning step), and a fixing apparatus for fixing the toner image on the transferring material (fixing step) and the photosensitive member is repeatedly applied with an electrophotography process (charging, exposing, developing, transferring, cleaning) to form an image.

Inside of the cleaning apparatus is provided with a waste toner collecting container for containing the toner remaining on the photosensitive member removed from the face of the photosensitive member by the cleaning apparatus. Therefore, it is necessary to make the container large-sized to constitute an apparatus having long service life, which is disadvantageous in view of small-sized formation of the apparatus.

Hence, there is an image forming apparatus of a cleanerless system abolishing the cleaning apparatus having the waste toner collecting container and removing and collecting the remaining transferring toner on the photosensitive member after the transferring step from above the photosensitive member by "developing and cleaning" in a developing apparatus.

The developing and cleaning is a method of disposing of the remaining transferring toner on the photosensitive member after transferring by charging the photosensitive member at a developing step at a succeeding step and thereafter, that is, successively, exposing the photosensitive member to form an electrostatic latent image, and collecting the remaining transferring toner present on a portion of the face of the photosensitive member (non-image portion) which is not to be developed by the toner by fog removing bias (a fog removing potential difference Vback which is a potential difference between direct current voltage applied to the developing apparatus and surface potential of the photosensitive member) in a procedure of the developing step of the electrostatic latent image.

According to the method, the remaining transferring toner is collected by the developing apparatus and reused in developing the electrostatic latent image at the succeeding step and thereafter and therefore, the waste toner can be eliminated and trouble of maintenance can be reduced and is advantageous in small-sized formation of the image forming apparatus by eliminating the waste toner container.

Meanwhile, in recent years, the charging means is switched to a corona charger, particularly, a roller charging system using a charging roller as a contact charging member is preferably used in view of stability of charging. According to the roller charging, a conductive elastic roller (charging roller) is brought into press contact with a charged body and the charged body is charged by applying voltage thereto.

With regard to the charging system, as disclosed in JP-A-63-149669, an AC charging system for applying voltage constituted by superposing an AC component having peak to peak voltage of 2×Vth or higher to DC voltage in correspondence with desired surface potential Vd of the charged body to a contact charging member has been proposed and reduced into practice. By the effect of smoothing potential by AC, charging can be made uniform more than a DC charging system and potential of the charged body is substantially converged to Vd which is a center of peaks of AC voltage.

According to the image forming apparatus of a cleanerless system for removing and collecting the remaining transferring toner on the photosensitive member after the transferring step by developing and cleaning in the developing apparatus, in the case of using the contact charging apparatus as the apparatus of charging the photosensitive member, when the remaining transferring toner on the photosensitive member passes a charging portion which is a contact nip portion of the photosensitive member and the contact charging apparatus, particularly a toner in the remaining transferring toner in which charge polarity is inverted to a polarity reverse to normal polarity is adhered to the contact charge apparatus and the contact charge apparatus is contaminated with the toner more than allowable to cause a charge failure.

The cause is derived from the fact the toner as the developer is mixed with a toner in which the charge polarity is inherently inverted to a polarity reverse to the normal polarity, or even a toner having the normal polarity of the charge polarity in which the charge polarity is inverted by being influenced by transferring bias or exfoliation discharge or removed of electricity and having a small charge amount, although an amount thereof is small.

That is, the remaining transferring toner is mixed with the toner having the normal polarity of the charge polarity, the inverted toner having reverse polarity and the toner having the small charge amount and the inverted toner or the toner having the small charge amount is liable to adhere to the contact charge apparatus when passing the charging portion which is the contact nip portion of the photosensitive member and the contact charge apparatus.

Further, in order to remove and collect the remaining transferring toner on the photosensitive member by developing and cleaning of the developing apparatus, it is necessary that the charge polarity of the remaining transferring toner on the photosensitive member carried to the developing portion by passing the charging portion is the normal polarity and the charge amount is the charge amount of the toner capable of developing the electrostatic latent image of the photosensitive member by the developing apparatus. The inverted toner or the toner having the impertinent charge amount cannot be removed and collected from the photosensitive member to the developing apparatus to cause a failed image.

Hence, in JP-A-2001-215798, the applicant has proposed an image forming apparatus provided with uniform remaining transferring toner forming means (first charge providing means) downstream from a transferring portion and provided with a developer charge amount controlling means) (second charge providing means) upstream from charging means for charging the photosensitive member further downstream therefrom.

According to the image forming apparatus, the uniform remaining transferring forming means is means for eliminating a pattern of a remaining toner image in a shape of a pattern on an image bearing member carried from the transferring portion to the developer charge amount controlling means by dispersing to distribute the remaining toner pattern at a face of the image bearing member. Specifically, the pattern of the image of the remaining developer is scratched to destroy or disturbed by abrading the face of the image bearing member by an abrading member to disperse to distribute the developer on the face of the image bearing member.

By providing the image uniform remaining transferring toner forming means, a total normal polarity charging processing is always sufficiently carried out for the remaining transferring toner by the developer charging amount controlling means applied with a successive normal polarity and the remaining transferring toner can effectively be prevented from adhering to the charging means. Further, by erasing the pattern of the image of the remaining toner, a ghost image of the pattern of the image of the remaining toner can be prevented from being brought about.

That is, in the case of absence of the uniform remaining developer image forming means, when transferability of the image of the developer is poor, by, for example, an image of the developer in a vertical line pattern, environment, sheet kind (transferring sheet) or secondary color, the image of the remaining transferring toner in the shape of the pattern on the image bearing member is increased and the image of the remaining transferring toner is carried as it is to the developer charging amount controlling means and developer concentrates on a portion of the developer charging amount controlling means, thereby, there is brought about a phenomenon (toner charge failure phenomenon) in which the charge amount of the remaining developer cannot be controlled at the portion of the developer charging amount controlling means. As a result, there is brought about contamination of the charge member→charge failure→fogged image formation, or the pattern of the image of the remaining toner remains and the ghost image is brought about.

By providing the uniform remaining toner image forming means, as described above, in the remaining transferring toner image in the shape of the pattern above the image bearing member carried from the transferring portion to the developer charging amount controlling means, even when an amount of the developer is large, the developer is dispersed to distribute at the face of the image bearing member and the patternless formation is produced and therefore, the developer does not concentrate on the portion of the developer charging amount controlling means, the processing of charging a total of the remaining transferring developer into the normal polarity by the developer charging amount controlling means is carried out always sufficiently and the remaining transferring developer is effectively prevented from adhering to the charging means. The ghost image of the remaining developer image pattern is strictly prevented from being brought about.

Further, simultaneously with charging the photosensitive member to predetermined potential by the charging means, the charge amount of the remaining transferring toner charged to the normal polarity by the developer charge amount controlling means is controlled to a pertinent charge amount capable of developing the electrostatic latent image of the photosensitive drum by the developing apparatus. As a result, the remaining transferring toner at the developing apparatus is efficiently collected and an excellent image without having a ghost or the charge failure is provided.

However, when the image is formed continuously by a pattern having a high printing ratio, an amount of the toner accumulated to the uniform remaining transferring toner forming means or the developer charge amount controlling means is increased. Thereby, lowering of charge capacity and deterioration of function are respectively brought about and the patternless formation of the remaining transferring toner and charge to the remaining transferring toner become insufficient to bring about adherence of the toner to the charging means.

Hence, even after continuously printing the pattern of the high printing ratio by a number of sheets, in order to maintain the functions of the uniform remaining transferring toner forming means and the developer charge amount controlling means, it is necessary to periodically discharge the toner accumulated on the uniform remaining transferring toner image forming means and the developer charge amount controlling means. For that purpose, the discharging operation is carried out between sheets or in initial operation when a power source is made ON or when printing operation is finished. In the discharging operation (discharging mode), a bias for positively discharging the accumulated toner is applied. For example, it is known that it is effective to apply a bias having a polarity reverse to that of voltage applied in printing operation or make the bias ON/OFF at short intervals.

Thereby, even in the case of forming an image continuously by a pattern having a high printing ratio, even when an amount of accumulating the toner to the uniform remaining transferring toner forming means or the developer charge amount controlling means is increased, by discharging the accumulated toner by discharging operation at each time, the uniform remaining transferring toner forming means or the developer charge amount controlling means is always refreshed to prevent a deterioration of the charging capacity and function. Thereby, the patternless formation of the remaining transferring toner and charging to the remaining transferring toner can sufficiently be carried out and the toner can be prevented from adhering to the charging means.

However, the following problem is posed in the discharging operation from the uniform remaining transferring toner image forming means and the developer charging amount controlling means.

There poses a problem that the discharged developer (toner) is adhered to the charging member and charge failure and charge nonuniformity are brought about to produce a failure image in forming a successive image.

This is because in the toner discharged from the uniform remaining transferring toner image forming means and the developer charge amount controlling means, other than the toner having the normal charge polarity, there is the reverse toner having the reverse polarity of the charge polarity and the toner having the small charge amount although the toner is provided with the normal polarity and the charge voltage (AC+DC) in the printing operation stays to be applied, the reverse toner or the toner having the small charge amount is adhered to the charging member when passing the nip portion of the contact charge member and the photosensitive member.

Further, the amount of discharging the toner is larger than an amount of the remaining transferring toner in forming a normal image and an amount thereof adhered to the charging member is increased more than normal. By adhering the toner to the charging member, a nonuniformity in charging is brought about, thereby, an image of a fogged image or the like is produced.

Hence, in order to prevent the toner from adhering to the charging member, for example, there is conceivable a method of pertinently switching direct current voltage applied to the charging means when operation of discharging the remaining transferring toner from the uniform remaining transferring toner forming means and operation of discharging the remaining transferring toner from the developer charge amount controlling means are carried out.

However, in order to carry out the method, it is necessary to grasp potential of a photosensitive drum in the discharging operation in details and it is necessary to finely switch voltage applied to the charging member in accordance therewith.

Further, a power source for applying voltage having a polarity reverse that in printing is needed for the charging member to thereby pose a problem of bringing about large-sized formation of a total of the apparatus.

SUMMARY OF THE INVENTION

It is an object of the invention to provide an image forming apparatus improving discharge of a developer from a charge providing means for providing charge to a developer remaining on an image bearing member to the image bearing member.

It is other object of the invention to provide an image forming apparatus for constituting surface potential of an image bearing member by a potential suitable for discharging a developer when the developer is discharged from charge providing means.

It is other object of the invention to provide an image forming apparatus for properly setting voltage applied to charging means for an image bearing member for a region constituting a region of discharging a developer of the image bearing member.

It is other object of the invention to provide an image forming apparatus improving discharge of a developer respectively from first and second charge providing means for providing charge to a developer remaining on an image bearing member to the image bearing member.

It is other object of the invention to provide an image forming apparatus for preventing a developer from adhering to charging means from a region of discharging the developer.

It is other object of the invention to provide an image forming apparatus for making a region of discharging a developer from first charge providing means to an image bearing member and a region of discharging the developer from second charge providing means to the image bearing member differ from each other.

It is other object of the invention to provide an image forming apparatus suitable for a cleanerless system which is not provided with an exclusive cleaner.

Further object and characteristic of the invention will become apparent further by reading the following detailed description in reference to the attaching drawings.

DETAILED DESCRIPTION OF THE PREFERRED EMBODIMENTS

A preferred embodiment of the invention will be explained to exemplify in details in reference to the drawings as follows. Incidentally, dimensions, materials and the shapes of constituent parts and an arrangement relative to each other described in the embodiment are to be pertinently changed by a constitution of an apparatus to which the invention is applied and various conditions and the range of the invention is not intended to limit to the following embodiment.

Figure 1:
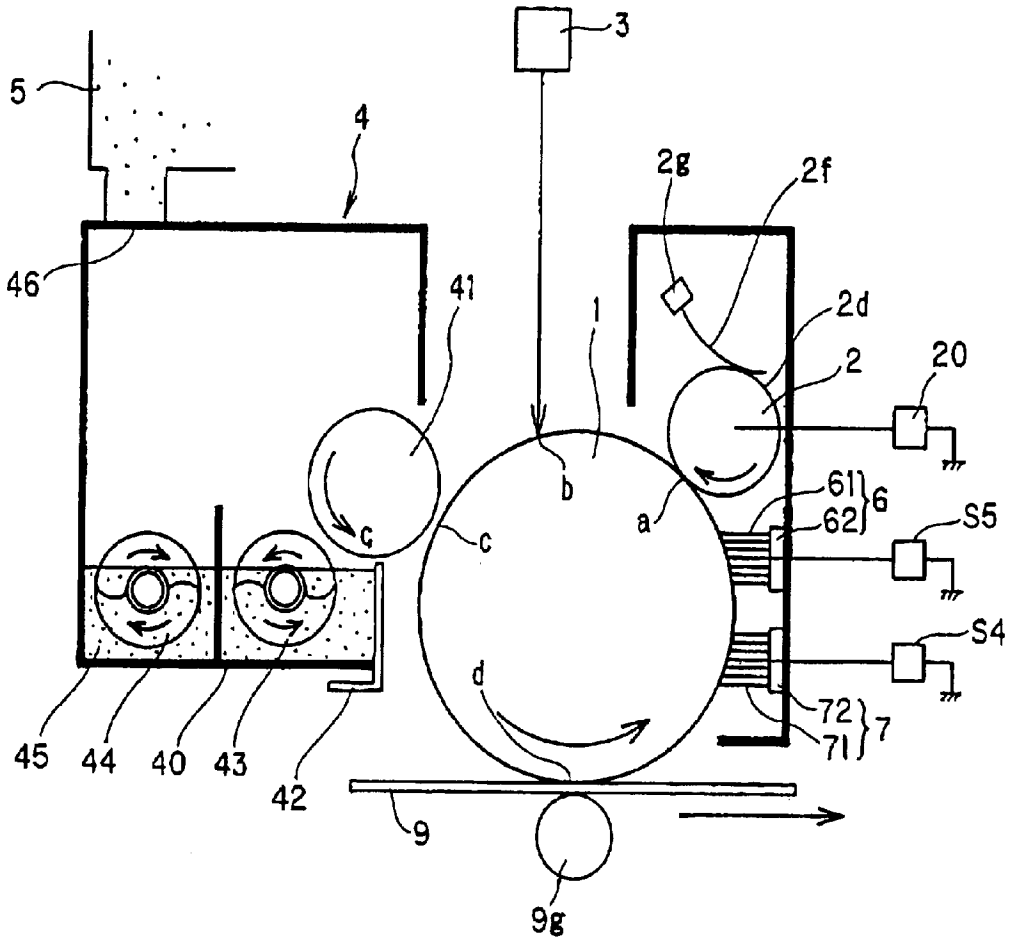
FIG. 1 is an outline sectional view of an essential portion of an image forming apparatus according to an embodiment.
Figure 2:
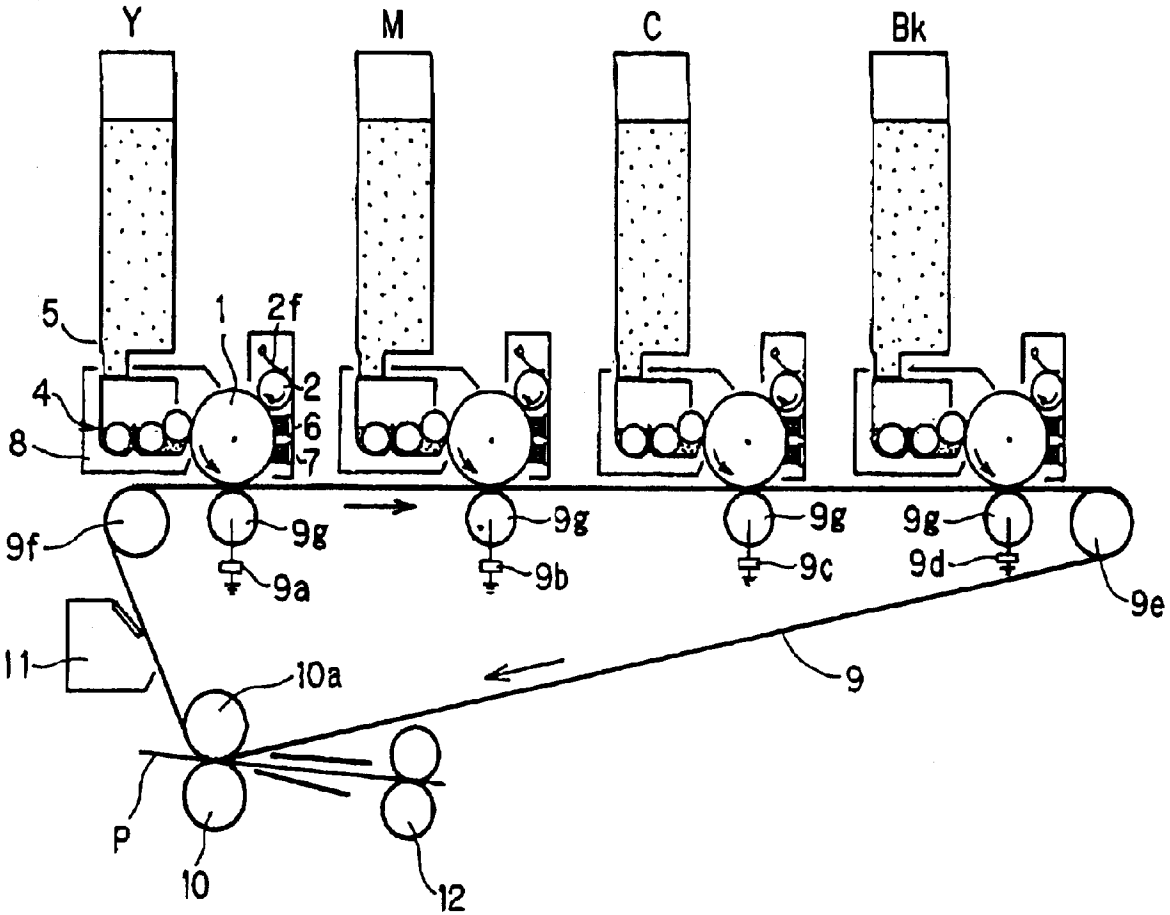
FIG. 2 is an outline sectional view of the image forming apparatus according to the embodiment.

FIG. 1 is an outline constitution view of an essential portion of an image forming apparatus (image recording apparatus) according to the embodiment of the invention and FIG. 2 is an outline constitution view of the image forming apparatus (image recording apparatus) according to the embodiment of the invention.

A color laser printer as an image forming apparatus shown in FIG. 2 is a color laser printer using a transferring system electrophotography process, a contact charging system, an reverse developing system and a cleanerless system having a maximum passing sheet size of A3 size and is a four continuous drums system (inline) printer having a plurality of pieces of process cartridges (hereinafter, P-CRG) 8 and temporarily carrying out multiple transmission continuously on an intermediate transferring belt 9 which is an image bearing member to provide a full color print image. Image forming operation of the image forming apparatus is controlled by controlling means. An explanation will be given of a constitution of the image forming apparatus and the image forming operation as follows.

In FIG. 2, the intermediate transferring belt 9 in an endless shape is suspended on a drive roller 9*e*, a tension roller 9*f* and a secondary transferring opposed roller 10*a* and rotated in an arrow mark direction in the drawing.

Four pieces of P-CRG8 are arranged in an order of yellow, magenta, cyan and black in series with the intermediate transferring belt 9.

An explanation will be given of P-CRG8 in reference to FIG. 1 as follows. Although in the following explanation, a description will mainly be given of P-CRG8 for developing a yellow toner, the description is similar also with regard to other P-CRG.

In P-CRG8 for developing the yellow toner, numeral 1 designates an electrophotography photosensitive member of a rotary drum type (photosensitive drum) as an image bearing member. The photosensitive drum 1 is an organic photoconductor (OPC) drum having an outer shape dimension of 50 mm and is driven to rotate in the clockwise direction indicated by an arrow mark by a process speed (peripheral speed) of 100 mm/sec centering on a central support shaft.

The photosensitive drum 1 is constructed by a constitution of coating to laminate three layers of a matrix layer restraining interference of light and promoting adhering performance of an upper layer, a photoelectric charge generating layer and a charge transporting layer (thickness: 20 $\mu$m) on a surface of a cylinder made of aluminum (base member of conductive drum) successively from a lower side (center side).

In a charging step, a charging roller 2 as a contact charger constituting charging means is supplied with voltage of a predetermined condition from a power source 20 as first charge applying means for charging a face of the photosensitive drum 1 uniformly in a negative polarity.

A longitudinal length of the charging roller 2 is 320 mm and a charging roller 2 is constructed by a three layers structure successively laminating a lower layer, a middle layer and a surface layer 2*d* from a lower side (center side) around a core bar (supporting member) thereof. The lower layer is a foamed sponge layer for reducing charge sound, the middle layer is a resistance layer for providing uniform resistance over a total of the charging roller and the surface layer 2*d* is a protecting layer provided for preventing occurrence of leakage even when a defect of a pin hole or the like is present on the photosensitive drum 1.

According to the charge roller 2 of the embodiment, a stainless circular rod having a diameter of 6 mm is used as the core bar, carbon is dispersed in fluororesin as the surface layer 2*d*, an outer diameter of the roller is 14 mm and roller resistance falls in a range of $10^4$ Ω through $10^7$ Ω.

According to the charging roller 2, both end portions of the core bar are respectively supported rotatably by bearing members and brought into press contact with the surface of the photosensitive drum 1 by predetermined press force by being urged in a direction of the photosensitive drum 1 by a press spring and rotated to follow rotation of the photosensitive drum 1.

Further, by applying predetermined oscillating voltage constituted by superposing alternating voltage at frequency f to direct current voltage (bias voltage Vdc+Vac) from the power source 20 via the core bar to the charging roller 2, a peripheral face of the rotating photosensitive drum 1 is charged to predetermined potential.

According to the embodiment, the oscillating voltage is constituted by superposing a sine wave of alternating voltage; frequency f=1150 Hz, peak to peak voltage Vpp=1400V on direct current voltage; −500V and the peripheral face of the photosensitive drum 1 is charged by contact uniformly to −500V (dark potential Vd). That is, when a region constituting an image forming region of the photosensitive drum 1 is disposed at a charging position of the charging roller 2, the charging roller 2 is applied with the voltage superposed with an alternating current component and a direct current component.

In FIG. 2, notation 2*f* designates a charging roller cleaning member which is a flexible cleaning film according to the embodiment. The cleaning film 2*f* is arranged such that one end thereof is fixed to a supporting member 2*g* arranged in parallel with a longitudinal direction of the charging roller 2 and moving reciprocally in the longitudinal direction by a constant amount and a contact nip is formed along with the charging roller 2 at a face thereof at a vicinity of a free end side thereof.

The supporting member 2*g* is driven to move reciprocally by the constant amount in the longitudinal direction by a drive motor of the printer via a gear train and the surface layer 2*d* of the charging roller is abraded by the cleaning film 2*f*. Thereby, an attached contaminant (fine powder toner, outside adding agent or the like) of the surface layer 2*d* of the charging roller is removed. Further, it is preferable to set the cleaning film 2*f* to a material for bringing the toner into a normal charging polarity by electrification by contact with the toner adhered to the charging roller. Because according to the embodiment, the normal charging polarity of the toner is the same as a polarity of the direct current component applied to the charging roller and therefore, the toner adhered to the charging roller is easy to return to the photosensitive drum.

After having been charged uniformly to predetermined polarity and potential by the charging roller 2, by receiving image exposure by image exposing means (information writing means of a color decomposing and focusing exposure optical system of a colored draft image, a scanning exposure system by laser scan outputting laser beam modulated in correspondence with time-sequential electric digital pixel signal of image information) 3, not illustrated, an electrostatic latent image in correspondence with a first color component image (yellow component image) in a desired color image is formed.

According to the embodiment, as exposing apparatus, a laser beam scanner using a semiconductor laser is used and a uniformly charged face of the photosensitive drum 1 is subjected to laser scanning exposure (image exposure) by outputting laser beam modulated in correspondence with an image signal transmitted from a host apparatus of an image reading apparatus or the like, not illustrated, to the printer side.

By lowering potential of a portion of the face of the photosensitive drum 1 irradiated with laser beam by the laser scanning exposure, the face of the rotating photosensitive drum 1 is formed with an electrostatic latent image in correspondence with image information subjected to scanning exposure. According to the embodiment, the potential of the exposed portion is set to −150V.

Successively, the electrostatic latent image is developed by the yellow toner constituting first color by a first developing apparatus 4 (yellow developer).

An explanation will be given here of the first developing apparatus 4 (yellow developer) as the developer in reference to FIG. 1.

The developing apparatus 4 is a two components contact developing apparatus (two components magnetic brush developing apparatus). Numeral 40 designates a development container and numeral 41 designates a nonmagnetic development sleeve including a magnetic roller, not illustrated, fixedly arranged at inside thereof. The development sleeve 41 is rotatably arranged at inside of the development container 40 while exposing a portion of an outer peripheral face thereof to outside. Numeral 42 designates a developer restricting blade. Numeral 45 designates a two components developer which is a mixture of the toner and a magnetic carrier contained in the development container 40 and numerals 43 and 44 designate developer stirring members arranged at a bottom side of the development container 40.

The developer restricting blade 42 is provided to the development sleeve 41 with a predetermined gap therebetween and a developer thin layer is formed on the development sleeve 41 in accordance with rotation of the development sleeve 41 in an arrow mark C direction.

The development sleeve 41 is arranged proximately and opposedly to the photosensitive drum 1 while maintaining a nearest distance between the photosensitive drum 1 and the development sleeve 41 (referred to as S-Dgap) at 350 μm. A portion at which the photosensitive drum 1 and the development sleeve 41 are opposed to each other is a developing portion c. The development sleeve 41 is driven to rotate in a direction reverse to an advancing direction of the photosensitive drum 1 at the developing portion c. The developer thin film on the development sleeve 41 is brought into contact with a face of the photosensitive drum 1 at the developing portion c to pertinently abrade the face of the photosensitive drum. The development sleeve 41 is applied with predetermined developing bias from a power source, not illustrated.

According to the embodiment, developing bias voltage applied to the development sleeve 41 is oscillating voltage superposed with direct current voltage (Vdc) and alternating current voltage (Vac). More specifically, the developing bias voltage is oscillating voltage superposed with Vdc=−350V and Vac=1800V at frequency=2300 Hz.

Further, by coating the developer as the thin layer on the face of the rotating development sleeve 41 and selectively adhering the toner in the developer carried to the developing portion c on the face of the photosensitive drum 1 in correspondence with an electrostatic latent image by an electric field produced by the developing bias, the electrostatic latent image is developed as a toner image. In the case of the embodiment, the electrostatic latent image is invertedly developed by adhering the toner having negative polarity to an exposure bright portion of the face of the photosensitive drum 1. That is, the charge polarity of the photosensitive drum 1 is a polarity the same as the normal charge polarity of the toner.

The developer thin layer on the development sleeve 41 after passing the developing portion c is returned to a developer storage portion at inside of the development container 40 successively in accordance with rotation of the development sleeve 41.

There are the stirring screws 43 and 44 for stirring the developer at inside of the developing apparatus 4 which are rotated in synchronism with rotation of the sleeve and provided with a function of stirring the toner and the carrier which are replenished and providing predetermined tribology to the toner.

A sensor portion, not illustrated, for detecting a toner concentration in the developer by detecting a change in the magnetic permeability of the developer is provided at a wall face of the developing apparatus 4 upstream from the screw 44 and a toner replenishing opening 46 is provided more or less downstream from the sensor. After carrying out developing operation, the developer is conveyed to the sensor portion and the toner concentration is detected. In order to maintain the toner concentration in the developer constant in accordance with a result of the detection, by pertinently rotating a screw, not illustrated, at inside of a developer supplying unit (hereinafter, T-CRG) 5, the toner is replenished therefrom by passing the toner replenishing opening 46 of the developing apparatus 4.

The replenished toner is carried by the screw 44, mixed with the carrier to be provided with pertinent tribology, thereafter conveyed to a vicinity of the sleeve 41 and formed into the thin layer on the development sleeve 41 to subject to developing operation.

According to the embodiment, as the toner, a negatively charged toner having a mean particle size of 6 $\mu$m is used and as a carrier, there is used a magnetic carrier having the saturation magnetization of 205 emu/cm$^3$ (magnetizing amount per 1000 gauss (0.1T) of 56.9 Am$^2$/Kg (incidentally, specific weight of 3.6 g/cm$^3$)) and a means particle size of 35 $\mu$m. Further, a mixture of the toner and the carrier by weight ratio of 6:94 is used as the developer.

Further, a charging amount of the toner developed on the photosensitive drum 1 is −25 $\mu$C/g.

Next, transferring means will be explained.

In FIG. 2, the yellow image formed on the photosensitive drum 1 advances to a primary transferring nip portion with the intermediate transferring belt 9 which is an image receiving member. At the transferring nip portion, a transferring roller 9*g* which is transferring means is brought into press contact with a rear side of the intermediate transferring belt 9 by predetermined press force. The transferring rollers 9*g* are provided with primary transferring bias sources of 9*a* through 9*d* as fourth voltage applying means to enable to apply bias independently at respective image forming stations. The intermediate transferring belt 9 is firstly transferred with yellow at the image forming station of the first color and successively subjected to multiple transfer of respective colors of magenta, cyan and black successively at respective stations from the photosensitive drums 1 in correspondence with respective colors processed by a step similar to the above-described.

According to the embodiment, in consideration of a transferring efficiency for the toner developed by V1 (potential −150V) at an exposing portion, voltage of +350V is applied for all of first color through fourth color as primary transferring bias. A four color full color image formed on the intermediate transferring belt 9 is successively transferred summarizingly on a transferring material P transmitted from a sheet feeding roller 12 by a secondary transferring roller 10 and melted to fix by a fixing apparatus, not illustrated, to thereby provide a color print image.

Remaining secondary transferring toner remaining on the intermediate transferring belt 9 is cleaned by a blade of an intermediate transferring belt cleaner 11 and is made to prepare for a successive image forming step.

As a selection of a material of the transferring belt 9, in order to improve registration at the respective color stations, an expandable and contractible material is not preferable and a rubber belt of resin species or including a metal core bar or a belt of resin plus rubber is preferable.

According to the embodiment, a resin belt formed by dispersing carbon in PI (polyimide) and controlling the volume resistivity to an order of $10^8$ Ω·cm is used. A thickness thereof is 80 $\mu$m, a dimension in a longitudinal direction is 320 mm and a dimension of a total periphery thereof is 900 mm.

Further, the transferring roller 9*g* comprises conductive sponge, resistance thereof is equal to or lower than $10^6$ Ω, an outer diameter thereof is 16 mm and a longitudinal length thereof is 315 mm.

In FIG. 1, at a location ordinarily arranged with a clean blade, developer charge amount controlling means 6 (second charge providing means for providing charge to remaining developer) and uniform remaining developer forming controlling means 7 (first charge providing means for providing charge to remaining developer) are brought into contact with the photosensitive drum 1. Both of them use brush members comprising conductive fiber according to the embodiment.

Specifically, the developer charge amount controlling means 6 (second brush) is provided with a conductive brush portion 61 at an electrode plate 62 having a long transverse length and the uniform remaining developer forming controlling means 7 (first brush) is similarly provided with a conductive brush portion 71 at an electrode plate 72. Further, the brush portions 61 and 71 are arranged to be brought into contact with the face of the photosensitive drum 1 and to be fixedly supported by the electrode plate 62 and 72.

Resistance values of the brush portions 61 and 71 are controlled by including carbon or metal power in fiber of rayon, acrylic resin or polyester. The brush portions 61 and 71 each is preferably provided with a thickness equal to or smaller than 30 deniers, a density of 1550 through 77500 pieces/cm$^2$ (1 through 500,000/inch$^2$) such that the brush portions 61 and 71 can uniformly be brought into contact with the surface of the photosensitive drum and the remaining transferring toner. According to the embodiment, in both of the brush portions 61 and 71, the thickness is 6 deniers, the density is 15500 pieces/cm$^2$ (100,000 pieces/inch$^2$), the fiber length is 5 mm and resistance of the blush is $6\times10^3$ Ω·cm.

The developer charge amount controlling means 6 and the uniform remaining developer forming controlling means 7 are brought into contact with the photosensitive drum 1 such that an amount of invading the face of the photosensitive drum 1 of the brush portions 61 and 71 becomes 1 mm and a width of contact nip portions thereof is set to 5 mm.

The cleanerless system of the embodiment is realized by controlling the developer charge amount controlling means 6 and the uniform remaining developer forming controlling means 7 by controlling means.

The cleanerless system is a system in which the remaining transferring toner remaining on the face of the photosensitive drum after transfer is made to pass a charging portion a and an exposing portion b to thereby carry out developing and cleaning (collecting) by the developing apparatus 3. That is, charging, exposing and developing are carried out while the toner is present on the photosensitive drum 1.

Although the remaining transferring toner on the face of the photosensitive drum 1 passes the exposing portion b and therefore, the exposing step is carried out from above the remaining transferring toner, since an amount of the remaining transferring toner is small, significant influence is not effected thereby.

Immediately after transfer, the remaining transferring toner is mixed with the toner having the normal polarity of the charge polarity, the toner having reverse polarity (reverse toner) and the toner having the small charge amount and when the reverse toner or the toner having the small charging amount thereamong passes the charging portion a, such a toner is adhered to the charging roller 2 to thereby contaminate the charging roller 2 more than allowable and to bring about charging failure.

Further, in order to effectively carry out developing and cleaning of the remaining transferring toner on the face of the photosensitive drum 1 by the developing apparatus 3, it is necessary that the charge polarity of the remaining transferring toner on the photosensitive drum 1 conveyed to the developing portion c is the normal charge polarity and the charging amount is an amount of charging the toner capable of developing the electrostatic latent image of the photosensitive drum 1 by the developing apparatus. The reverse toner or the toner having an impertinent charging amount cannot be removed and collected from above the photosensitive drum to the developing apparatus to thereby cause a failed image.

Further, with a variety of user needs in recent years, the above-described problem is further promoted by simultaneously producing a large amount of the remaining transferring toner by continuous printing operation of an image having a high printing ratio such as a photograph image.

Hence, at positions downstream from the transferring portion d in the rotational direction of the photosensitive drum and upstream from the charging portion a, in order to make the remaining transferring toner on the photosensitive drum 1 uniform and bring the charge polarity of the remaining transferring toner evenly to a negative polarity which is the normal polarity, the uniform remaining developer forming controlling means 7 which is the first charge providing means and the developer charge amount controlling means 6 which is the second charge providing means are provided.

The uniform remaining developer forming controlling means 7 is applied with voltage having a positive polarity (positive bias=+350V) from a power source S4 as second voltage applying means with respect to an image forming region of the photosensitive drum 1.

Although the remaining transferring toner is mixed with the toner having the reverse polarity or the toner hardly having the polarity, the toner charged to a vicinity of null polarity or the negative polarity among them is attracted by the uniform remaining developer forming controlling means 7 by electric and physical force. Further, the toner is provided with the reverse polarity (positive polarity) by the positive bias of the uniform remaining developer forming controlling means 7 and the toner is gradually separated and adhered onto the photosensitive drum 1 again and carried.

By the operation, the distribution of the toner on the photosensitive drum 1 is made uniform and a large amount of the toner is prevented from simultaneously flowing to the developer charge amount controlling means 6 downstream therefrom. Further, potential on the photosensitive drum 1 becomes a vicinity of 0V. By bringing the remaining transferring toner to the polarity reverse to the normal charge polarity of the toner (positive polarity) and making the potential above the photosensitive drum 1 near to 0V, as described later, the developer charge amount controlling means 6 also serves to be able to sufficiently provide charge to the toner.

The developer charge amount controlling means 6 is applied with voltage having negative polarity (negative bias=−800V) from a power source S5 as third voltage applying means with respect to the image forming region of the photosensitive drum 1.

When passing the developer charge amount controlling means 6, the charge polarity of the remaining transferring toner on the photosensitive drum is evenly brought into the negative polarity which is the normal charge polarity. The toner is evenly brought into the positive polarity by the first brush (uniform remaining developer forming controlling means 7), the potential on the photosensitive drum 1 is made to be near to 0V and therefore, the strong negative polarity can further effectively be brought about evenly.

By bringing the charge polarity of the remaining transferring toner evenly to the negative polarity which is the normal polarity by the developer charge amount controlling means 6, at the charging portion a disposed downstream therefrom, when the face of the photosensitive drum 1 is charged from above the remaining transferring toner, mirroring force to the photosensitive drum 1 is increased and the remaining transferring toner is prevented from adhering to the charging roller 2. That is, since the direct current component of voltage applied to the charging roller 2 is negative, the remaining transferring toner is prevented from adhering thereto. Further, the toner passing the charging roller 2 without adhering thereto is subjected to developing and cleaning at the developing apparatus 4 to collect. That is, the toner is collected from the dark portion of the photosensitive drum 1 to the developing apparatus 4 and at the same time, the toner is developed from the developing apparatus 4 to the bright portion of the photosensitive drum 1.

In order to collect the remaining transferring toner on the photosensitive drum 1 to the developing apparatus 4 by such a method, it is necessary that the remaining transferring toner is provided with a proper toner charge amount.

However, in order to collect the remaining transferring toner significantly charged to the negative polarity by the developer charge amount controlling means 6 at the developing apparatus 4 in order to prevent the toner from adhering to the charging roller 2 as described above, it is necessary to remove electricity thereof.

The electricity of the remaining transferring toner significantly charged to the negative polarity by the developer charge amount controlling means 6 is removed by alternating current of alternating voltage (frequency f 1150 Hz, Vpp 1400V) applied to the charging roller 2 and the charging amount of the toner after passing the charging portion a substantially becomes the same as the charging amount of the developing toner.

Further, in the developing step, the remaining transferring toner on the photosensitive drum 1 in an unexposed portion at which the toner is not to be developed, is completely brought into the negative polarity evenly and the electricity thereof is pertinently removed by the charging roller 2 and mirroring force to the photosensitive drum 1 can be reduced and therefore, the remaining transferring toner is firmly collected into the developing apparatus 4 by the above-described relationship between drum potential of −500V and the DC component of the developing bias of −350V. According to the embodiment, as mentioned above, the development sleeve 41 is rotated in the direction reverse to the advancing direction of the face of the photosensitive drum 1 at the developing portion c which is advantageous in collecting the remaining transferring toner on the photosensitive drum 1.

When with a variety of user needs in recent years, when continuous printing operation of an image having a high printing ratio such as photograph image is carried out, a large amount of the remaining transferring toner is produced and an amount of the toner accumulated in the uniform remaining developer forming controlling means 7 and the developer charge amount controlling means 6 is increased. When printing operation is repeated successively under the state, lowering of the function of the developer charge amount controlling means 6 and deficiency of charging force thereof are brought about to thereby pose a problem of contamination of the charging roller by the toner and recovery failure of the developing apparatus.

Further, in discharging the toner from the uniform remaining developer forming controlling means 7 and the developer charge amount controlling means 6 to the photosensitive drum 1, when a bias similar to that in ordinary printing is applied to the charging roller 2, the charging roller 2 is contaminated by the toner discharged from the brushes to bring about nonuniformity of charging and failure in charging and image failure is produced on a successive image after the discharging operation.

Hence, in order to prevent the toner from adhering to the charging roller 2, according to the embodiment, the toner discharging operation is carried out by the following condition.

In discharging the toner from the uniform remaining developer forming controlling means 7 and the developer charge amount controlling means 6 to the photosensitive drum 1, in order to prevent the discharged toner from adhering to the charging roller 2, the alternating current component (AC voltage) is made OFF and the voltage applied to the charging roller 2 is only constituted by the direct current component (Vdc1). By making the AC voltage OFF, the effect of removing electricity at the charging portion a is lost and the adherence to the charging roller 2 is significantly reduced. That is, when a region of the photosensitive drum 1 discharged with the developer at which the developer is discharged from the uniform remaining developer forming controlling means 7 and the developer charge amount controlling means 6, is disposed at the charging position of the charging roller 2, the alternating current component of the voltage applied to the charging roller 2 is made OFF.

Further, the toner discharged from the uniform remaining developer forming controlling means 7 is mainly of the normal polarity (negative polarity) and the toner discharged from the developer charge amount controlling means 6 is mainly of the reverse polarity (positive polarity) Therefore, in order to prevent the toner from adhering to the charging roller 2 even when the toner having either of the polarities is discharged without switching a complicated sequence, with respect to the discharging region, the voltage applied to the charging roller 2 is only constituted by the direct current component Vdc1 and Vdc1 becomes a value satisfying a relationship of Equation (1) shown below relative to potential Vc1 at which the face of the photosensitive drum 1 to which the toner is discharged by the toner charge amount controlling means 6 is brought into the charging roller nip portion.

$$Vdc1 = Vc1 \quad (1)$$

That is, the direct current voltage applied to the charging roller 2 is made to be at potential the same as that of the face of the photosensitive drum 1. That is, when the region of the photosensitive drum 1 discharging the developer is disposed at the charging position, the alternating current component of the voltage applied to the charging roller 2 is made OFF and the direct current component is substantially the same as the surface potential of the developer discharging region and therefore, even when the toners having the positive polarity and the negative polarity are present on the photosensitive drum 1, an electric field by which the toner is adhered from the developer discharging region to the charging roller 2 is not formed. Therefore, the toners having the two polarities can be prevented from adhering to the charging roller 2.

However, on the other hand, in the case in which the region of the photosensitive drum 1 for constituting the developer discharging region is previously charged by the charging roller 2, when the developer discharging operation is carried out for the developer discharging region, the following problem may be posed.

When the developer discharging operation is carried out for the region to constitute the developer discharging region which is previously charged, there is a case in which discharge is brought about at the uniform remaining developer forming controlling means 7 and the developer charge amount controlling means 6, the potential of the face of the photosensitive drum 1 is disturbed, the developer discharging region of the photosensitive drum 1 and the charging roller 2 are not brought under the same potential and the discharged toner is adhered to the charging roller 2.

This is because since the voltage applied to the uniform remaining developer forming controlling means 7 in discharging is the positive polarity, when the photosensitive drum 1 is charged to a negative polarity of constant potential or higher, discharge is brought about between the uniform remaining developer forming controlling means 7 and the developer discharging region of the photosensitive drum 1. However, when the voltage applied to the uniform remaining developer forming controlling means 7 in discharging the developer is made ON/OFF, the developer can efficiently be discharged when the voltage value is large to some degree.

Hence, according to the embodiment, the discharging operation is carried out by the following method.

As previous operation of carrying out the developer discharging operation of the uniform remaining developer forming controlling means 7 and the developer charging amount controlling means 6 substantially simultaneously, operation of bringing the potential of the photosensitive drum 1 to substantially 0V by applying only the alternating current voltage to the charging roller 2, in carrying out the developer discharging operation, voltage applied to the uniform remaining developer forming controlling means 7 and the developer charge amount controlling means 6 is applied with voltage to a degree of not varying the potential of the face of the photosensitive drum 1 substantially at 0V by the discharging operation (±300V according to the embodiment) and the charging roller 2 is set to substantially 0V relative to the discharged face of the photosensitive drum 1.

That is, first, when the region of the photosensitive drum 1 for constituting the developer discharging region is disposed previously at the charging position, the alternating current component of the voltage applied to the charging roller 2 is made ON and the direct current component is set to 0V. Thereby, the surface potential of the region for constituting the developer discharging region becomes substantially 0V. When the region reaches the position of the uniform remaining developer forming controlling means 7, the voltage applied to the uniform remaining developer forming controlling means 7 is set to +300V and when the region reaches the position of the developer charge amount controlling means 6, the voltage applied to the developer charge amount controlling means 6 is set to −300V. Therefore, the developer is discharged from the uniform remaining developer forming controlling means 7 and the developer charge amount controlling means 6 to the developer discharging region while the surface potential of the developer discharging region stays to be substantially 0V. When the developer discharging region discharged with the developer reaches successively to the charging position, the alternating current component of the voltage applied to the charging roller 2 is made OFF and the direct current component is fixed to 0V. Therefore, the potential of the developer discharging region and the potential of the charging roller 2 becomes substantially the same and therefore, even when both of the toners having the positive polarity and the toner having the negative polarity are adhered to the developer discharging region, the toners can be prevented from adhering to the charging roller 2.

Further, when the region for constituting the developer discharging region is disposed previously at the charging position, the direct current component applied to the charging roller is preferably set to 0V as described above. Because when 0V is continued to apply to the charging roller, the potential of the photosensitive drum 1 stays to be 0V and therefore, the developer discharging operation can be continued during a time period of one rotation of the photosensitive drum 1 or more. Further, since the potential of the photosensitive drum 1 becomes 0V, after finishing the developer discharging operation, rotation of the photosensitive drum 1 can also be stopped as it is. However, it is also possible to set the direct current component applied to the charging roller to an absolute value equal to or smaller than an absolute value of voltage applied to the uniform remaining developer forming controlling means 7 and the developer charge amount controlling means 6 in the developer discharging operation (300V in this case). In this case, the absolute value of the potential of the photosensitive drum 1 at the region for constituting the developer discharging region becomes equal to or lower than 300V. Further, although it is preferable that the direct current component applied to the charging roller 2 is set to 0V as described above when the developer discharging region reaches the charging region, the voltage can also be set to an absolute value equal to or smaller than the absolute value of the voltage applied to the uniform remaining developer forming controlling means 7 and the developer charging amount controlling means 6 (300V in this case) in the developer discharging operation.

Here, in order to prevent the potential of the region (developer discharging region) of the photosensitive drum 1 substantially at 0V from varying by the developer discharging operation, it is preferable that the voltage applied to the uniform remaining developer forming controlling means 7 and the developer charging amount controlling means 6 in the developer discharging portion is set to voltage equal to or lower than charge starting voltage in image forming operation.

Thereby, the uniform remaining developer forming controlling means 7 and the developer charge amount controlling means do not provide charge to the developer discharging region and therefore, the surface potential of the developer discharging region remains unchanged before and after discharging the developer. Therefore, even when the developer discharging operation is carried out, the relationship of Equation (1) can continuously be satisfied and therefore, the charging roller 2 can firmly be prevented from being adhered with the developer.

Most of the discharged toner is collected by electrostatic and physical abrasion basically by the developing apparatus using contact two components counter development. However, the toner of the normal polarity having the small charging amount and the toner having the reverse polarity may not be completely collected by the developing apparatus. However, the toners are transferred from above the photosensitive drum to above the intermediate transferring belt by being transferred by press contact by the transferring nip and removed from above the belt by the intermediate transferring belt cleaner. In the discharging operation of the developer charging amount controlling means 6, when voltage having a polarity reverse to the normal polarity (negative polarity) is applied as the transferring bias by the primary transferring bias source 9*a* through 9*d*, the toner having the positive polarity is easy to transfer further effectively.

Thereby, the discharged toner mixed with the normal polarity and the reverse polarity can be made to pass the charging nip portion without being adhered to the charging roller 2.

By carrying out the charging operation under the condition, the charging roller can be prevented from being contaminated by the discharged toner and an excellent image can always be formed.

Next, when the discharging operation of the uniform remaining developer forming controlling means 7 and the developer charge amount controlling means 6 are carried out substantially simultaneously, in order to carry out more efficient discharging operation by preventing the toner discharged from the uniform remaining developer forming controlling means 7 from adhering to the developer discharge amount controlling means 6, voltage Vb applied to the developer charging amount controlling means 6 is preferably set to a value satisfying a relationship of Equation (2) shown below relative to potential Vc2 at which the face of the photosensitive drum 1 at which the toner has been discharged from the uniform remaining developer forming controlling means 7 is brought into the nip portion of the developer charge amount controlling means 6.

$$Vc2=Vb \quad (2)$$

That is, the voltage applied to the developer charge amount controlling means 6 is at potential the same as that of the face of the photosensitive drum 1 to which the toner has been discharged by the uniform remaining developer forming controlling means 7. Here, substantially, Vc2=0V and therefore, Vb=0V. A first developer discharging region to which the developer is discharged from the uniform remaining developer forming controlling means 7 is set to 0V and when the first developer discharging region reaches the position of the developer charging amount controlling means 6, voltage applied to the developer charge amount controlling means 6 is se to 0V.

In order to carry out the discharging operation of the uniform remaining developer forming controlling means 7 and the developer charge amount controlling means 6 substantially simultaneously while satisfying the condition, for example, according to the embodiment, when the uniform remaining developer forming means 7 carries out discharging operation by repeating ON/OFF operation, at a time point of making the uniform remaining developer forming controlling means 7 OFF, it is conceivable to carry out discharging operation of the developer charge amount controlling means 6 for a section of the face of the photosensitive drum 1 passing the uniform remaining developer forming means 7.

Specifically, discharging operation of the uniform remaining developer forming controlling means 7 is carried out by repeating ON/OFF by 10 times at intervals of 50 msec by the uniform remaining developer forming controlling means 7 and discharging operation from the developer charging amount controlling means 6 is carried out for a portion at which the uniform remaining developer forming controlling means 7 is made OFF. A behavior at the time is shown by FIGS. 3A and 3B.

First, during a time period in which the face of the photosensitive drum 1 passing the uniform remaining developer forming controlling means 7 during a time period of 50 msec at which the bias applied to the uniform developer forming controlling means 7 is made OFF, passes the nip portion of the developer charge amount controlling means 6, the operation of making the developer charge amount controlling means 6 ON for 30 msec is carried out.

Figure 3A:
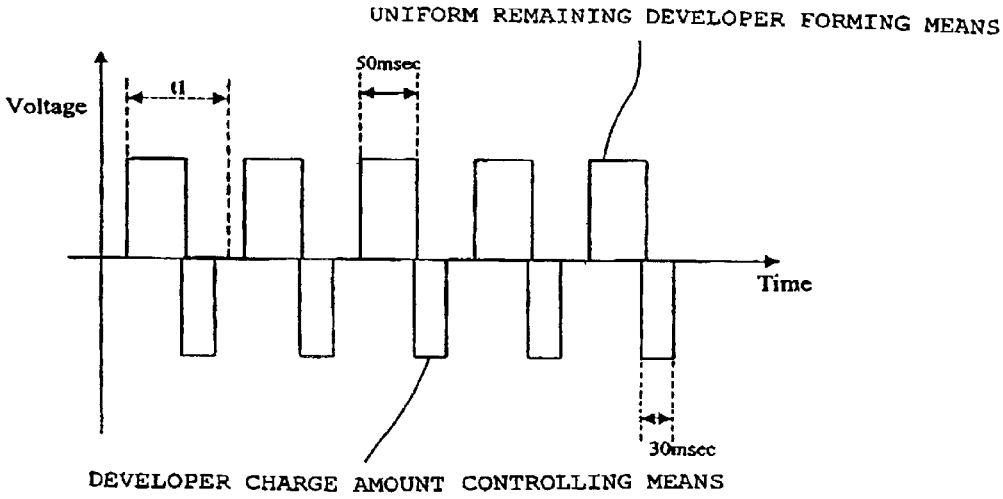
FIGS. 3A and 3B are diagrams for explaining a behavior of discharging operation according to the embodiment.

FIG. 3A shows a timing of making the uniform remaining developer forming controlling means 7 and the developer charge amount controlling means 6 ON/OFF in the discharging operation of the respective means by taking time by the abscissa and voltage by the ordinate. A time period t1 in the drawing is a time period taken until a face on the photosensitive drum 1 at which the uniform remaining developer forming controlling means 7 carries out the discharging operation is brought into the developer charging amount controlling means 6 and when the uniform remaining developer forming controlling means 7 is made OFF, the developer charge amount controlling means 6 carries out the discharging operation for the face on the photosensitive drum 1 passing the uniform remaining developer forming controlling means 7. As the voltage, +300V is applied when the uniform remaining developer forming controlling means 7 is made ON and −300V is applied when the developer charge amount controlling means 6 is made ON.

Figure 3B:
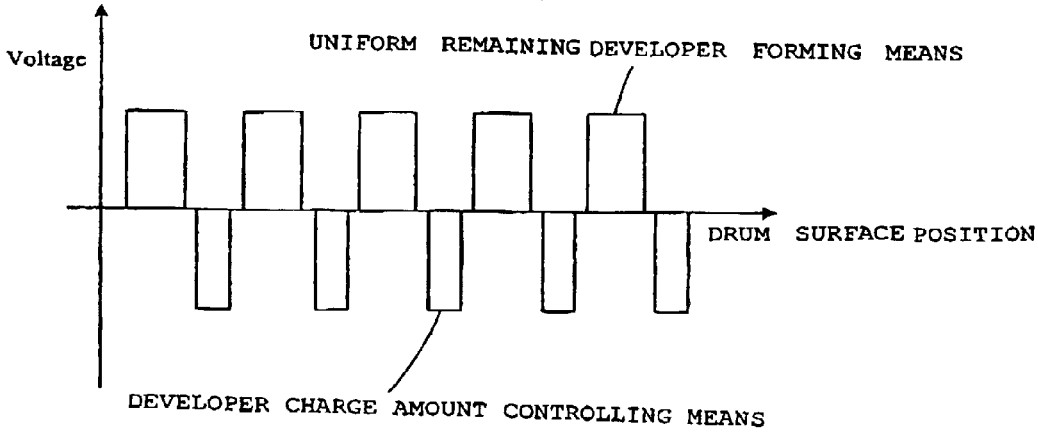

FIG. 3B shows timings of making the uniform remaining developer forming controlling means 7 and the developer charge amount controlling means 6 ON/OFF in the discharging operation of the respective means by taking an advancing direction of a face on the photosensitive drum 1 by the abscissa and the voltage by the ordinate. With respect to the advancing direction of the photosensitive drum 1, the face at which discharging from the uniform remaining developer forming controlling means 7 is carried out and the face at which discharging from the developer charge amount controlling means 6 is carried out alternately appear.

Thereby, the discharging operation can be carried out without adhering the toner discharged from the uniform remaining developer forming controlling means 7 again to the developer charge amount controlling means 6. That is, as is known from FIG. 3B, when the voltage applied to the uniform remaining developer forming controlling means 7 is made ON, the developer having the positive polarity is discharged from the uniform remaining developer forming controlling means 7 to the first developer discharging region of the photosensitive drum 1 and when the voltage applied to the uniform remaining developer forming controlling means 7 is set to 0V, the developer is not discharged from the uniform remaining developer forming controlling means 7 to the photosensitive drum 1 since there is not a potential difference between the uniform remaining developer forming controlling means 7 and the photosensitive drum 1. Further, when the first developer discharging region of the photosensitive drum 1 discharged with the developer having the positive polarity from the uniform remaining developer forming controlling means 7 reaches the position of the developer charge amount controlling means 6, since the voltage applied to the developer charge amount controlling means 6 is set to 0V, there is not the potential difference between the first developer discharging region and the developer charge amount controlling means 6 and the developer is not discharged from the developer charge amount controlling means 6 to the first developer discharging region. Meanwhile, when the voltage applied to the developer charge amount controlling means 6 is made ON, the developer having the negative polarity is discharged from the developer charge amount controlling means 6 to the second developer discharging region other than the first developer discharging region of the photosensitive drum 1. As shown by FIG. 3B, the first developer discharging region (region at which voltage applied to the uniform remaining developer forming controlling means is made ON) and the second developer discharging region (region at which voltage applied to the developer charge amount controlling means 6 is made ON) are repeatedly formed alternately. Further, the voltage of 300V applied to the uniform remaining developer forming controlling means 7 and the developer charge amount controlling means 6 is smaller than charge starting voltage by which the uniform remaining developer forming controlling means 7 and the developer charge amount controlling means 6 charge the photosensitive drum 1 and therefore, the surface potentials of the first and the second developer discharging regions remain unchanged at 0V.

Most of the toner discharged to the developer discharging region is collected by an electrostatic and physical abrasion basically by the developing apparatus using the contact two components counter development. However, the toner of the normal polarity having the small charge amount and the toner having the reverse polarity may not completely be collected by the developing apparatus. However, the toners are transferred from above the photosensitive drum 1 to above the intermediate transferring belt 9 by being transferred by press contact by the transferring nip and removed from above the belt by the intermediate transferring belt cleaner 11. In the discharging operation of the uniform remaining developer forming controlling means 6, when the voltage having the polarity reverse to the normal polarity (negative polarity) is applied as the transferring bias, the toner having the normal polarity is easy to transfer further effectively.

By carrying out the developer discharging operation under the condition, the charging roller can be prevented from being contaminated by the discharged toner and a time period of the discharging operation can be shortened by efficiently carrying out discharging of the uniform remaining developer forming controlling means 7 and the developer charge amount control means 6 while forming an excellent image always by maintaining the function to thereby enable to carry out discharging operation between sheets.

Specifically, the developer discharging operation can be carried out at, for example, every 100 sheets of A4 image by adding the operation in an initial operation of making the power source ON and in finishing the printing operation. Thereby, the toner can be prevented from accumulating to the uniform remaining developer forming controlling means 7 and the developer charge amount controlling means 6 even when several hundreds sheets are continuously printed.

As described above, according to the embodiment, in carrying out discharging from the uniform remaining developer forming controlling means and the developer charge amount controlling means, the charging operation is carried out after the potential of the photosensitive drum is previously set to 0V. At this occasion, the voltage by which the uniform remaining developer forming controlling means and the developer charge amount controlling means carry out discharging operation is voltage of a magnitude to a degree by which the potential of the photosensitive drum is not varied from 0V. Further, by applying the voltage to the developer charge amount controlling means to constitute potential the same as that of the face of the photosensitive drum at which the uniform remaining developer forming means has carried out the discharging operation, the toner discharged from the uniform remaining developer forming controlling means can be prevented from adhering again to the developer charge amount controlling means. Further, by bringing the photosensitive drum and the contact charging member to the same potential by setting the contact charge member to 0V, even when discharging from the uniform remaining developer forming controlling means and the developer charge amount controlling means is carried out simultaneously and the discharged toner is mixed with the toner having the normal polarity and the toner having the reverse polarity, the contact charge member can be prevented from being contaminated by the discharged toner and image failure can be prevented from being brought about by contaminating the contact charge member at an image after the discharging operation. Thereby, a printing time period can be shortened while always maintaining a high quality image without needing a large-scaled constitution.

Further, although according to the embodiment, the uniform remaining developer forming controlling means 7 and the developer charge amount controlling means 6 are constituted by fixed brush-like members, the member can be constituted by a member having an arbitrary mode of a brush rotating body, an elastic roller body and a sheet-like member.

Further, the image bearing member may be provided with a directly injecting charging property provided with a charge injecting layer having surface resistance of $10^9$ through $10^{14}$ Ω·cm. Even when the charge injecting layer is not used, a similar effect is achieved when, for example, a charge transporting layer falls in the above-described resistance range. The image bearing member may be an amorphous silicon photosensitive member having the volume resistivity at a surface layer thereof of about $10^{13}$ Ω·cm.

Charging means having a shape and a material of fur brush, felt or cloth can be used other than the charging roller as the flexible contact charging member. Further, charging means having more pertinent elasticity, conductivity, surface property and durability can be provided by a combination of various materials.

Further, as a waveform of the alternating current component (AC component, voltage in which the voltage value is changed periodically) applied to the contact charging member or the developing member, sine wave, rectangular wave or triangular wave can pertinently be used. The waveform may be a rectangular wave formed by making a direct current power source ON/OFF periodically.

Further, image exposing means as means for writing information to a charging face of the photosensitive drum as the image bearing member may be, for example, digital exposing means using a solid light emitting element array such as LED other than the laser scanning means of the embodiment. The image exposing means may be analog image exposing means constituting a draft illuminating light source by a halogen lamp or a fluorescent lamp. In sum, the image exposing means may be able to form the electrostatic latent image in correspondence with image information.

What is claimed is:

1. An image forming apparatus comprising:

an image bearing member;

charging means for charging the image bearing member at a charging position, said charging means being capable of being applied with a voltage including a direct current component and an alternating current component;

developing means for developing an electrostatic image formed at the image bearing member by a developer;

transferring means for transferring an image of the developer formed at the image bearing member to an image receiving member; and charge providing means provided downstream from the transferring means and upstream from the charging means in a direction of moving the image bearing member for providing a charge to the developer remaining on the image bearing member, said charge providing means being applied with a voltage having a polarity the same as a normal charge polarity of the developer;

wherein when a developer discharging region of the image bearing member at which the developer is discharged from the charge providing means to the image bearing member is disposed at the charging position, the charging means is applied with a voltage having a direct current component of an absolute value equal to or smaller than an absolute value of the voltage applied to the charge providing means without an alternating current component thereof.

2. The image forming apparatus according to claim 1, wherein when the developer discharging region is disposed at the charging position, the direct current component applied to the charging means is substantially at 0V.

3. The image forming apparatus according to claim 1, wherein a surface potential of a region being to constitute the developer discharging region is set to substantially 0V.

4. The image forming apparatus according to claim 1, wherein when a region being to constitute the developer discharging region is disposed at the charging position, the charging means is applied with a voltage having an alternating current component and a direct current component an absolute value of which is smaller than the absolute value of the voltage applied to the charge providing means.

5. The image forming apparatus according to claim 4, wherein when the region being to constitute the developer discharging region is disposed at the charging position, the direct current component applied to the charging means is set to substantially 0V.

6. The image forming apparatus according to any one of claims 3 through 5, wherein when the developer is discharged from the charge providing means to the developer discharging region, the charge providing means is applied with a voltage by which the surface potential of the developer discharging region remains unchanged.

7. The image forming apparatus according to claim 6, wherein when the developer is discharged from the charge providing means to the developer discharging region, the charge providing means is applied with a voltage equal to or lower than a charge starting voltage of the image bearing member.

8. The image forming apparatus according to claim 1, wherein when the developer discharging region is disposed at the transferring position of the transferring means, the transferring means is applied with a voltage having a polarity the same as a normal charging polarity of the developer.

9. The image forming apparatus according to claim 1, wherein the developer discharging region is a region different from an image forming region of the image bearing member.

10. The image forming apparatus according to claim 1, wherein when the developer is discharged from the charge providing means to the developer discharging region, an ON/OFF operation is repeated at the voltage applied to the charge providing means.

11. The image forming apparatus according to claim 1, wherein the charging means is provided in contact with the image bearing member.

12. The image forming apparatus according to claim 1, wherein the charge providing means is provided in contact with the image bearing member.

13. The image forming apparatus according to claim 12, wherein the charge providing means includes a fiber brush.

14. The image forming apparatus according to claim 1, wherein the voltage applied to the charge providing means includes an alternating current component.

15. The image forming apparatus according to claim 1, wherein the developing means can collect the developer remaining on the image bearing member simultaneously with carrying out a developing operation.

16. An image forming apparatus comprising:

an image bearing member;

charging means for charging the image bearing member at a charging position;

developing means for developing an electrostatic image formed at the image bearing member by a developer;

transferring means for transferring an image of the developer formed on the image bearing member to an image receiving member;

first charge providing means provided downstream from the transferring means and upstream from the charging means in a direction of moving the image bearing member for providing a charge to the developer remaining on the image bearing member, said first charge providing means being applied with a voltage having a polarity reverse to a normal charge polarity of the developer; and second charge providing means provided downstream from the first charge providing means and upstream from the charging means in the direction of moving the image bearing member for providing a charge to the developer remaining on the image bearing member, said second charge providing means being applied with a voltage having a polarity the same as a normal charge polarity of the developer;

wherein a surface potential of a region being to constitute a developer discharging region of the image bearing member at which the developer is discharged from the first and the second charge providing means to the image bearing member is set to substantially 0V.

17. The image forming apparatus according to claim 16, wherein the charging means can be applied with a voltage including a direct current component and an alternating current component and when the developer charging region is disposed at the charging position, the charging means is applied with a voltage including a direct current component of an absolute value equal to or lower than absolute values of respective voltages applied to the first and the second charge providing means without an alternating current component.

18. The image forming apparatus according to claim 17, wherein when the developer discharging region is disposed at the charging position, the direct current component applied to the charging means is set to substantially 0V.

19. The image forming apparatus according to claim 16, wherein when the developer is discharged from the first and the second charge providing means to the developer discharging region, each of the first and the second voltage providing means is applied with a voltage by which the surface potential of the developer discharging region remains unchanged.

20. The image forming apparatus according to claim 19, wherein when the developer is discharged from the first and the second charge providing means to the developer discharging region, each of the first and the second charge providing means is applied with a voltage equal to or lower than a charge starting voltage of the image bearing member.

21. The image forming apparatus according to claim 16, wherein when the developer discharging region is disposed at the transferring position of the transferring means, the transferring means is applied with a voltage having a polarity the same as a normal charge polarity of the developer.

22. The image forming apparatus according to claim 16, wherein the developer discharging region is a region different from an image forming region of the image bearing member.

23. The image forming apparatus according to claim 16, wherein an ON/OFF operation is repeated at the respective voltages applied to the first and the second charge providing means such that a first developer discharging region of the image bearing member formed with an electric field for discharging the developer from the first charge providing means to the image bearing member and a second developer discharging region of the image bearing member formed with an electric field for discharging the developer from the second charge providing means to the image bearing member differ from each other.

24. The image forming apparatus according to claim 23, wherein when the first developer discharging region is disposed at a position of the second charge providing means, a potential of the first developer discharging region and a potential applied to the second charge providing means are substantially the same.

25. The image forming apparatus according to claim 16, wherein the charging means is provided in contact with the image bearing member.

26. The image forming apparatus according to claim 16, wherein the first and the second charge providing means are provided in contact with the image bearing member.

27. The image forming apparatus according to claim 16, wherein the first and the second charge providing means include fiber brushes.

28. The image forming apparatus according to claim 16, wherein each of the voltages applied to the first and the second charge providing means includes alternating current components.

29. The image forming apparatus according to claim 16, wherein the developing means can collect the developer remaining on the image bearing member simultaneously with carrying out a developing operation.

30. An image forming apparatus comprising:

an image bearing member;

charging means for charging the image bearing member at a charging position, said charging means being capable of being applied with a voltage including a direct current component and an alternating current component;

developing means for developing an electrostatic image formed at the image bearing member by a developer;

transferring means for transferring an image of the developer formed at the image bearing member to an image receiving member;

first charge providing means provided downstream from the transferring means and upstream from the charging means in a direction of moving the image bearing member for providing a charge to the developer remaining on the image bearing member, said first charge providing means being applied with a voltage having a polarity reverse to a normal charge polarity of the developer; and second charge providing means provided downstream from the first charge providing means and upstream from the charging means in the direction of moving the image bearing member for providing a charge to the developer remaining on the image bearing member, said second charge providing means being applied with a voltage having a polarity the same as the normal charge polarity of the developer;

wherein when a region being to constitute a developer discharging region of the image bearing member discharged with the developer from the first and the second charge providing means to the image bearing member is disposed at the charging position, the charging means is applied with a voltage including an alternating current component and a direct current component an absolute value of which is smaller than absolute values of voltages supplied to the first and the second charge providing means.

31. The image forming apparatus according to claim 30, wherein when the developer discharging region is disposed at the charging position, the charging means is applied with a voltage including a direct current component of an absolute value equal to or smaller than the absolute values of the voltages applied to the first and the second charge providing means without an alternating current component thereof.

32. The image forming apparatus according to claim 31, wherein when the developer discharging region is disposed at the charging position, the direct current component applied to the charging means is set to substantially 0V.

33. The image forming apparatus according to claim 30, wherein when the region being to constitute the developer discharging region is disposed at the charging position, the direct current component applied to the charging means is set to substantially 0V.

34. The image forming apparatus according to claim 30, wherein when the developer is discharged from the first and the second charge providing means to the developer discharging region, each of the first and the second charge providing means is applied with a voltage by which a surface potential of the developer discharging region remains unchanged.

35. The image forming apparatus according to claim 34, wherein when the developer is discharged from the charge providing means to the developer discharging region, each of the first and the second charge providing means is applied with a voltage equal to or lower than a charge staring voltage of the image bearing member.

36. The image forming apparatus according to claim 30, wherein when the developer discharging region is disposed at the transferring position of the transferring means, the transferring means is applied with a voltage having a polarity the same as the normal charge polarity of the developer.

37. The image forming apparatus according to claim 30, wherein the developer discharging region is a region different from an image forming region of the image bearing member.

38. The image forming apparatus according to claim 30, wherein an ON/OFF operation is repeated at respective voltages applied to the first and the second charge providing means such that a first developer discharging region of the image bearing member formed with an electric field for discharging the developer from the first charge providing means to the image bearing member and a second developer discharging region of the image bearing member formed with an electric field for discharging the developer from the second charge providing means to the image bearing member differ from each other.

39. The image forming apparatus according to claim 38, wherein when the first developer discharging region is disposed at a position of the second charge providing means, a potential of the first developer discharging region and a potential applied to the second charge providing means are substantially the same.

40. The image forming apparatus according to claim 30, wherein the charging means is provided in contact with the image bearing member.

41. The image forming apparatus according to claim 30, wherein the first and the second charge providing means are provided in contact with the image bearing member.

42. The image forming apparatus according to claim 41, wherein the first and the second charge providing means include fiber brushes.

43. The image forming apparatus according to claim 30, wherein each of the voltages applied to the first and the second charge providing means includes alternating current components.

44. The image forming apparatus according to claim 30, wherein the developing means can collect the developer remaining on the image bearing member simultaneously with carrying out a developing operation.

45. An image forming apparatus comprising:

an image bearing member:

charging means for charging an image bearing member at a charging position;

developing means for developing an electrostatic image formed at the image bearing member by a developer;

transferring means for transferring an image of the developer formed at the image bearing member to an image receiving member;

first charge providing means provided downstream from the transferring means and upstream from the charging means in a direction of moving the image bearing member for providing a charge to the developer remaining on the image bearing member, said first charge providing means being applied with a voltage having a polarity reverse to a normal charge polarity of the developer; and second charge providing means provided downstream from the first charge providing means and upstream from the charging means in the direction of moving the image bearing member for providing a charge to the developer remaining on the image bearing member, said second charge providing means being applied with a voltage having a polarity the same as the normal charge polarity of the developer; and wherein an ON/OFF operation is repeated to respective voltages applied to the first and the second charge providing means such that a first developer discharging region of the image bearing member formed with an electric field for discharging the developer from the first charge providing means to the image bearing member and a second developer discharging region of the image bearing member formed with an electric field for discharging the developer from the second charge providing means to the image bearing member differ from each other.

46. The image forming apparatus according to claim 45, wherein surface potentials of regions being to constitute the first and the second developer discharging regions are set to substantially 0V.

47. The image forming apparatus according to claim 45, wherein when regions being to constitute the first and the second developer discharging regions are disposed at the charging position, the charging means is applied with a voltage including an alternating current component and a direct current component an absolute value of which is smaller than an absolute value of the voltage applied to the charge providing means.

48. The image forming apparatus according to claim 47, wherein when the regions being to constitute the first and the second developer discharging regions are disposed at the charging position, the direct current component applied to the charging means is set to substantially 0V.

49. The image forming apparatus according to claim 45, wherein when the developer is discharged from the first charge providing means to the first developer discharging region and when the developer is discharged from the second charge providing means to the second developer discharging region, each of the first and the second charge providing means is applied with voltages by which surface potentials of the first and the second developer discharging regions remain unchanged.

50. The image forming apparatus according to claim 49, wherein when the developer is discharged from the first charge providing means to the first developer discharging region and when the developer is discharged from the second charge providing means to the second developer discharging region, the each of the first and the second charge providing means is applied with voltages equal to or lower than a charge starting voltage of the image bearing member.

51. The image forming apparatus according to claim 45; wherein when the second developer discharging region is disposed at the transferring position of the transferring means, the transferring means is applied with a voltage having a polarity the same as the normal charge polarity of the developer.

52. The image forming apparatus according to claim 45, wherein the first and the second developer discharging regions are regions different from an image forming region of the image bearing member.

53. The image forming apparatus according to claim 45, wherein when the first developer discharging region is disposed at a position of the second charge providing means, a potential of the first developer discharging region and a potential applied to the second charge providing means are substantially the same.

54. The image forming apparatus according to claim 45, wherein the charging means is provided in contact with the image bearing member.

55. The image forming apparatus according to claim 45, wherein the first and the second charge providing means are provided in contact with the image bearing member.

56. The image forming apparatus according to claim 55, wherein the first and the second charge providing means include fiber brushes.

57. The image forming apparatus according to claim 45, wherein the each of the voltages applied to the first and the second charge providing means includes alternating current components.

58. The image forming apparatus according to claim 45, wherein the developing means can collect the developer remaining on the image bearing member simultaneously with carrying out a developing operation.

59. An image forming apparatus comprising:

an image bearing member;

charging means for charging the image bearing member at a charging position, said charging means being capable of being applied with a voltage including a direct current component and an alternating current component;

developing means for developing an electrostatic image formed at the image bearing member by a developer;

transferring means for transferring an image of the developer formed at the image bearing member to an image receiving member;

first charge applying means provided downstream from the transferring means and upstream from the charging means in a direction of moving the image bearing member for providing a charge to the developer remaining on the image bearing member, said first charge providing means being applied with a voltage having a polarity reverse to a normal charge polarity of the developer; and second charge providing means provided downstream from the first charge providing means and upstream from the charging means in the direction of moving the image bearing member for providing a charge to the developer remaining on the image bearing member, said second charge providing means being applied with a voltage having a polarity the same as the normal charge polarity of the developer;

wherein a surface potential of a region being to constitute a developer discharging region of the image bearing member discharged with the developer from the first and the second charge providing means to the image bearing member is set to substantially 0V;

wherein when the developer is discharged from the first and the second charge providing means to the developer discharging region, the first and the second charge providing means are applied with a voltage such that the surface potential of the developer discharging region remains unchanged; and wherein when the developer discharging region is disposed at the charging position, the charging means is applied with a voltage including a direct current component of substantially 0V without an alternating current component.

60. The image forming apparatus according to claim 59, wherein when the region being to constitute the developer discharging region is disposed at the charging position, the charging means is applied with a voltage including the alternating current component and the direct current component of substantially 0V.

61. The image forming apparatus according to claim 59, wherein when the developer is discharged from the first and the second charge providing means to the developer discharging region, the charge providing means is applied with a voltage equal to or lower than a charge starting voltage of the image bearing member.

62. The image forming apparatus according to claim 59, wherein when the developer discharging region is disposed at the transferring position of the transferring means, the transferring means is applied with a voltage having a polarity the same as the normal charge polarity of the developer.

63. The image forming apparatus according to claim 59, wherein the developer discharging region is a region different from an image forming region of the image bearing member.

64. The image forming apparatus according to claim 59, wherein an ON/OFF operation is repeated for respective voltages applied to the first and the second charge providing means such that a first developer discharging region of the image bearing member formed with an electric field for discharging the developer from the first charge providing means to the image bearing member and a second developer discharging region of the image bearing member formed with an electric field for discharging the developer from the second charge providing means to the image bearing member differ from each other.

65. The image forming apparatus according to claim 64, when the first developer discharging region is disposed at a position of the second charge providing means, a potential of the first developer discharging region and a potential applied to the second charge providing means are substantially the same.

66. The image forming apparatus according to claim 59, wherein the charging means is provided in contact with the image bearing member.

67. The image forming apparatus according to claim 59, wherein the first and the second charge providing means are provided in contact with the image bearing member.

68. The image forming apparatus according to claim 60, wherein the first and the second charge providing means include fiber brushes.

69. The image forming apparatus according to claim 59, wherein the voltages applied to the first and the second charge providing means include alternating current components.

70. The image forming apparatus according to claim 59, wherein the developing means can collect the developer remaining on the image bearing member simultaneously with carrying out a developing operation.

* * * * *

UNITED STATES PATENT AND TRADEMARK OFFICE

CERTIFICATE OF CORRECTION

PATENT NO. : 6,807,384 B2
DATED : October 19, 2004
INVENTOR(S) : Kazuhiro Okubo et al.

It is certified that error appears in the above-identified patent and that said Letters Patent is hereby corrected as shown below:

Column 3,
Line 5, “means)” should read -- means --.

Column 6,
Line 26, “an” should read -- a --.

Column 9,
Line 59, “means” should read -- mean --.

Column 10,
Line 61, “plate 62” should read -- plates 62 --; and
Line 64, “power” should read -- powder --.

Column 17,
Line 17, “se” should read -- set --.

Column 18,
Line 45, “means” should read -- means 7 --.

Column 19,
Line 13, “control” should read -- controlling --; and
Line 55, “large-scaled” should read -- large-scale --.

Signed and Sealed this

Twenty-second Day of February, 2005

JON W. DUDAS
*Director of the United States Patent and Trademark Office*